US005386611A

United States Patent [19]

Kim

[11] Patent Number: 5,386,611

[45] Date of Patent: Feb. 7, 1995

[54] PAINT ROLLER

[76] Inventor: Ho C. Kim, 105 Windham Loop, Staten Island, N.Y. 10314

[21] Appl. No.: 170,425

[22] Filed: Dec. 20, 1993

[51] Int. Cl.[6] ..... B05C 17/02

[52] U.S. Cl. ..... 15/230.11; 15/143.1; 492/13

[58] Field of Search ..... 15/230.11, 230, 143.1, 15/144.1, 144.3; 401/9, 10, 11; 492/13, 39

[56] References Cited

U.S. PATENT DOCUMENTS

| | | | |
|---|---|---|---|
| 2,788,539 | 4/1957 | Santina | 15/230.11 |
| 2,799,884 | 7/1957 | Bedford | 15/230 |
| 2,813,292 | 11/1957 | McLendon | 15/230 |
| 2,824,328 | 2/1958 | Bedford | 15/230.11 |
| 2,904,813 | 9/1959 | Schleicher | 15/230 |
| 3,358,312 | 12/1967 | Parr | 15/230.11 |
| 3,562,837 | 2/1971 | Baginski et al. | 15/230.11 |
| 4,335,484 | 6/1982 | Ridge et al. | 15/230.11 |
| 5,035,022 | 7/1991 | Iuliano | 15/118 |

FOREIGN PATENT DOCUMENTS

| | | | |
|---|---|---|---|
| 136108 | 6/1979 | Germany | 15/230.11 |
| 3616114 | 11/1987 | Germany | 15/230.11 |
| 2172820 | 10/1986 | United Kingdom | 15/230.11 |

*Primary Examiner*—David A. Scherbel
*Assistant Examiner*—Tony G. Soohoo
*Attorney, Agent, or Firm*—Brumbaugh, Graves, Donohue & Raymond

[57] ABSTRACT

A paint roller support assembly comprises an elongated handgrip member having an internally threaded sleeve at its distal end and a roller-supporting rod member attached to the handgrip member by an externally threaded portion. The roller-supporting rod member is L-shaped, having mutually perpendicular leg portions. Each leg portion receives a rotatable paint roller assembly in a position such that longitudinal elements of the roller surfaces in the plane of the leg portions and nearest to the handgrip member form an internal corner. The threaded connection between the roller-supporting member and the handgrip member permits the roller assembly on the leg having the threaded portion to be removed and replaced. The paint roller support assembly is intended for simultaneously painting surfaces that face generally away from and laterally, relative to the user.

4 Claims, 1 Drawing Sheet

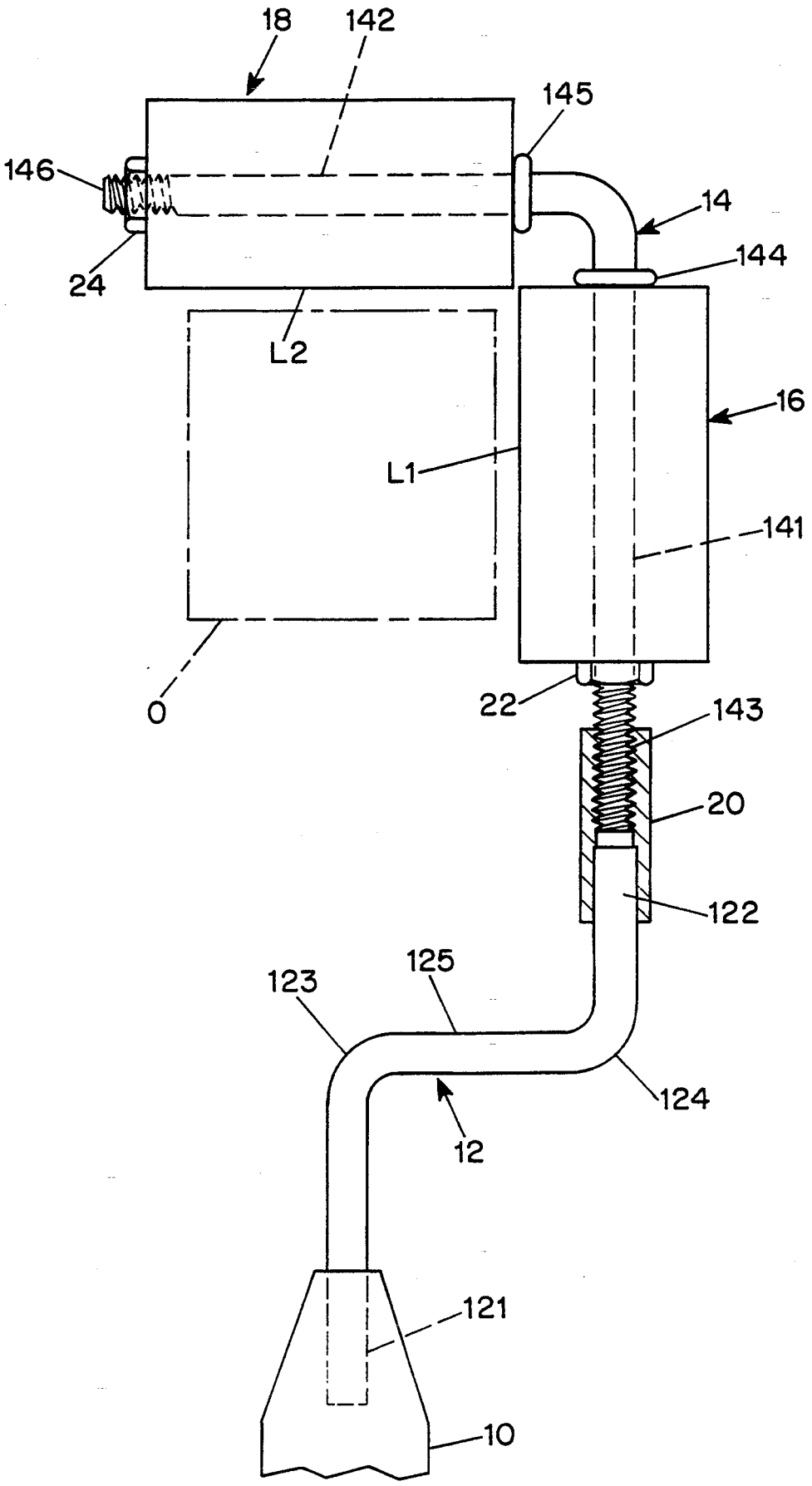
18
142
145
146
14
144
24
L2
16
L1
141
0
22
143
20
122
125
123
124
12
121
10

PAINT ROLLER

BACKGROUND OF THE INVENTION

Paint rollers are very popular for painting articles of all sorts, and a variety of special paint rollers have been proposed for unusual situations. U.S. Pat. No. 2,799,884 (Bedford, July, 1957) proposes a roller assembly having two roller-receiving leg portions joined at angles to each other for painting outside corners. U.S. Pat. No. 2,813,392 (McLendon, November, 1957) describes and shows a collection of three rollers arranged to embrace a portion of a cylindrical surface. U.S. Pat. No. 2,904,813 (Schleicher, September, 1959) shows a variety of arrangements of very narrow discs on supporting rods for rolling paint onto the entire peripheral surfaces of rod-like objects. Another three-roller system is proposed in U.S. Pat. No. 5,035,022 (Iuliano et al., July, 1991).

The paint roller arrangements of the above-mentioned patents are relatively complicated in construction, and the positions of the rollers relative to each other are such that while they may be effective to apply paint to the intended objects, applying the paint to the rollers from the usual paint tray by rolling each roller or groups of rollers in the tray is not possible. Moreover, the paint roller systems of those patents are intended primarily for painting surfaces that face the user or face laterally of the user.

SUMMARY OF THE INVENTION

An object of the present invention is to provide a multi-roll paint roller intended primarily for painting a surface that faces away from the user, i.e., a back surface, and, optionally but ordinarily, a lateral surface adjacent the back surface. Another object is to provide an arrangement of two paint rollers in which the paint can be applied to the two rollers from a conventional paint tray by rolling each roller about its axis, which is the usual and most effective way of applying paint to a paint roller. Another object is to provide a paint roller that is versatile in its utility and is of simple and inexpensive construction.

The foregoing objects are attained, in accordance with the present invention, by a paint roller support assembly comprising an elongated handgrip member having an axis, a roller-supporting rod member attached to and extending distally from the handgrip portion and having a distal end, and a roller-receiving rod member detachably joined to the distal end of the roller-supporting rod member. The roller-receiving rod member has a first leg portion adjacent to the distal end of the roller-supporting rod member that is adapted to receive a first paint roller assembly for rotation about its axis in a fixed position axially of the first leg portion, the axis of the first leg portion being substantially parallel to the axis of the handgrip member. The roller-receiving rod member also has a second leg portion that is adapted to receive a second paint roller assembly for rotation about its axis in a fixed position axially of the second leg portion. The axis of the second leg portion is substantially perpendicular to the axis of the first leg portion. The positions for the first and second paint roller assemblies on the respective first and second leg portions are such that when the roller assemblies are received on the leg portions, longitudinal elements of the roller surfaces in the plane of the leg portions and nearest to the handle member form an internal corner.

The second roller assembly is intended primarily for applying paint to the back surface of an object. One aspect of the versatility of the roller of the present invention is that the second roller assembly can also be used to apply paint to a surface facing the user. The first roller assembly, which is perpendicular to the second roller assembly and parallel to the handgrip member, is intended for applying paint to a surface generally laterally of a back or front surface. The paint roller of the present invention is especially useful for painting the elements of railings and fences in situations where the back surfaces of the elements are not easily accessible, for example the railing systems of terraces and balconies above the ground floor of a building, such as the external terraces commonly constructed in modern apartment buildings, the rail systems of elevated decks, and rail systems around stairwells. The roller of the present invention also facilitates painting fences at ground level, by enabling all surfaces to be painted from one side of the fence.

In a preferred embodiment, the roller-receiving rod member is affixed to the roller-supporting rod member by an internally threaded sleeve on the distal end of the roller-supporting rod member and external threads on an end portion of the first leg portion of the roller-receiving rod member. The position of the first roller assembly on the first leg portion is established at one end of the roller assembly by a threaded fastener received on the threaded end portion of the roller-receiving rod member and by an abutment at the other end. The second leg portion of the roller-receiving rod member has a distal end remote from the first leg portion, which distal end is threaded. The position of the second roller assembly is established at one end by a threaded fastener received on the threaded distal end and at the other end by an abutment on the second leg portion.

Preferably, the axis of the first leg portion of the roller-receiving rod member is offset from the axis of the handgrip member, and the axis of the handgrip member substantially bisects the position of the second roller assembly on the second leg portion of the roller-receiving rod member. By having the first roller offset laterally from the handle, paint can be applied to the first roller by holding the handgrip member laterally out from and above a side edge of a paint tray and rolling the first roller lengthwise of the tray. Paint is applied in a separate operation to the second roller in the usual manner (the second roller having the same orientation with respect to the handle as in a conventional paint roller).

For a better understanding of the invention, reference may be made to the following description of an exemplary embodiment, taken in conjunction with the accompanying drawings.

DESCRIPTION OF THE DRAWINGS

The drawing is an elevational view of an embodiment of the present invention, a portion being broken away in cross section.

DESCRIPTION OF THE EMBODIMENT

The paint roller support assembly, which is shown in the drawing with paint roller assemblies installed on it, includes an elongated handgrip member 10, which may be of molded plastic and to which the proximal end 121 of a roller-supporting rod member 12 is suitably attached. A roller-receiving rod member 14 is detachably joined to the distal end 122 of the roller-supporting rod member 12. The roller-receiving rod member has a first leg portion 141 adjacent to the distal end 122 of the roller-supporting rod member that is adapted to receive a first paint roller assembly 16 for rotation about its axis in a fixed position axially of the first leg portion 141, the axis of the first leg portion being substantially parallel to the axis of the handgrip member 10. The roller-receiving rod member 14 also has a second leg portion 142 that is adapted to receive a second paint roller assembly 18 for rotation about its axis in a fixed position axially of the second leg portion. The axis of the second leg portion is substantially perpendicular to the axis of the first leg portion. The positions for the first and second paint roller assemblies on the respective first and second leg portions are such that when the roller assemblies 16 and 18 are received on the leg portions 141 and 142, longitudinal elements of the roller surfaces in the plane of the leg portions and nearest to the handle member form an internal corner. In the drawing, those elements correspond to the lines L1 and L2 in the plane of the paper that demark the edges of the roller sleeves.

The rod members 12 and 14 are made from metal rod stock that is cut, bent and formed to the desired sizes and shapes and to provide for attaching them to each other, for permitting the roller assemblies to be installed and to be removed for replacement of the roller sleeves, and for establishing the positions of the roller assemblies. Various ways of meeting these requirements are well-known in the art and can be used in the present invention. The embodiment shown in the drawings is, therefore, merely exemplary.

The supporting rod member 12 is bent at two right angle bends 123 and 124 to provide an offset of the axis of the portion adjacent the distal end 122. An internally threaded sleeve 20 is suitably attached, such as by a press-fit, an adhesive, welding or brazing, or crimping it on, to the distal end 122. The proximal end portion 143 of the leg portion 141 has external threads that thread into the sleeve 20, the roller-receiving rod member 14 thus being removable from the roller-supporting rod member 12.

The position of the roller assembly 16 on the rod member 14 is established at the proximal end by a nut 22 threaded onto the threaded portion 142 and at the distal end by an abutment 144, which may be provided by beads pressed from the rod material or a collar affixed to the rod. The position of the roller assembly 18 on the leg portion 142 is maintained by an abutment 145 at the end nearer the leg portion 141 and by a nut 24 received on threads formed at the free end 146. The nuts 22 and 24 are shown in engagement with the ends of the roller assemblies for clarity and simplicity of illustration, but in practice they will usually be recessed into a cap at the end of the assembly. Wing nuts are preferred. Press-on fasteners can also be used.

The roller assemblies 16 and 18 can be of various constructions, many of which are known to those skilled in the art. Common to most roller assemblies is a replaceable sleeve having a pile covering and a pair of end caps having flanges that nest in the ends of the sleeve and central holes that receive the rod member on which to roller rotates. Longer rollers usually have an internal wire cage that extends between the end caps and structurally supports the sleeve.

The roller assembly 16 is removed from the leg portion 141 by unthreading and detaching the rod member 14 from the rod member 12, removing the nut 22 from the threaded end 143 and sliding the roller assembly off the end 143. The roller assembly 18 is removed from the leg portion 142 by removing the nut 24 and sliding it off the end 146. The roller assemblies are replaced on the roller-receiving rod member by reversing the procedure for removing them.

The roller assembly of the present invention, when fitted with just the roller assembly 18, can be used as a conventional single roller to paint a surface of an object that faces or is laterally of the user. Unlike most conventional paint rollers, it can also be used to paint a surface that faces away from the user. In that regard, the leg portion 141 provides a large offset distance between the lateral leg portion 125 of the roller-supporting rod member 12 and the nearest element (line L2) of the roller 18. As shown by the object O in the drawing, the spacing permits the roller 18 to engage the back face of an object.

When the roller 16 is installed, the roller can be used to paint a back surface and an adjacent lateral surface of an object O. By rotating the handgrip about its axis, a lateral surface (with respect to a back surface) may be at any inclination (vertical, horizontal, or any angle), so that the roller can be used for posts and rails of a rail system, for example. The front surfaces of objects can be painted at the same time as the backs and sides from the same position by using just the roller 18 to paint the front surfaces. By changing the orientation of the handle radially with respect to an object that is not of rectilinear cross section, such as a round post, all surfaces can be painted with the roller from a position on one side of the object.

To apply paint to the roller assembly when both rollers are fitted to it, the offset of the leg portion 141 with respect to the handle 10 allows the roller 16 to extend down into a paint tray. By holding the handle above and extending out laterally with respect to the tray and rolling the roller 16 endwise of the tray, paint is rolled onto the roller 16. The roller 18 can then be rolled lengthwise of the tray, like a conventional roller, to apply paint to it. Depending on the situation, paint can be applied to either roller alone, leaving the other roller idle during a particular phase of the job.

The handgrip member 10 and the roller-supporting rod member, as a unit, can be used with roller-receiving rod members of a variety of forms as well as with the double roll arrangement of the embodiment. The handgrip member can be provided with a threaded socket for use with an extension handle.

I claim:

1. A paint roller support assembly comprising an elongated handgrip member having an axis, a roller-supporting rod member attached to and extending distally from the handgrip member and having a distal end and having an internally threaded sleeve on said distal end, and a roller-receiving rod member detachably joined to the distal end of the roller-supporting rod member, the roller-receiving rod member having a first leg portion adjacent to the distal end of the roller-supporting rod member, the first leg portion having on an end portion thereof external threads detachably received in the threaded sleeve on the roller-supporting rod member, and the roller-receiving rod member further having an axis substantially parallel to the axis of the handgrip member, and being adapted to receive a first paint roller assembly for rotation about its axis in a fixed position axially of the first leg portion, and a second leg portion having an axis substantially perpendicular to the axis of the first leg portion and adapted to receive a second paint roller assembly for rotation about its axis in a fixed position axially of the second leg portion, the positions for the first and second paint roller assemblies on the respective first and second leg portions being such that when the roller assemblies are received on the leg portions, longitudinal elements of the roller surfaces in the plane of the leg portion and nearest to the handle form an internal corner, and the position of the first paint roller assembly on the first leg portion being established at one end of the first paint roller assembly by a threaded fastener received on the external threads on said first leg portion of the roller-receiving rod member and at the other end of the first paint roller assembly by an abutment on the first leg portion.

2. A paint roller support assembly according to claim 1 wherein the second leg portion of the roller-receiving rod member has a distal end remote from the first leg portion, which distal end is threaded, and wherein the position of the second roller assembly is established at one end by a threaded fastener received on the threaded distal end and by an abutment on the second leg portion at the other end.

3. A paint roller support assembly according to claim 1 wherein the axis of the first leg portion of the roller-receiving rod member is offset from the axis of the handgrip member.

4. A paint roller support assembly according to claim 1 wherein the axis of the handgrip member substantially bisects the position of the second roller assembly on the second leg portion of the roller-receiving rod member.

* * * * *